US010120306B2

(12) United States Patent
Ramackers et al.

(10) Patent No.: US 10,120,306 B2
(45) Date of Patent: Nov. 6, 2018

(54) GAS IMPINGEMENT DEVICE, RECORDING SUBSTRATE TREATMENT APPARATUS AND PRINTING SYSTEM COMPRISING SUCH GAS IMPINGEMENT DEVICE

(71) Applicant: OCÉ-TECHNOLOGIES B.V., Venlo (NL)

(72) Inventors: Hendrikus G. M. Ramackers, Venlo (NL); Stan H. P. Kersten, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/606,240

(22) Filed: May 26, 2017

(65) Prior Publication Data

US 2017/0261895 A1 Sep. 14, 2017

Related U.S. Application Data

(63) Continuation of application No. PCT/EP2015/077195, filed on Nov. 20, 2015.

(30) Foreign Application Priority Data

Nov. 28, 2014 (EP) ..... 14195318

(51) Int. Cl.

| | |
|---|---|
| ***G03G 15/20*** | (2006.01) |
| ***B41F 23/04*** | (2006.01) |
| *B41J 11/00* | (2006.01) |

(52) U.S. Cl.

CPC ..... *G03G 15/2021* (2013.01); *B41F 23/0466* (2013.01); *B41F 23/0469* (2013.01); *B41F 23/044* (2013.01); *B41J 11/0015* (2013.01); *G03G 15/2017* (2013.01)

(58) Field of Classification Search

None

See application file for complete search history.

(56) References Cited

U.S. PATENT DOCUMENTS

| | | | | |
|---|---|---|---|---|
| 5,553,397 | A | 9/1996 | Schwitzky et al. | |
| 7,909,453 | B2 * | 3/2011 | Noro | B41J 2/15 347/102 |
| 2004/0046850 | A1 | 3/2004 | Domoto et al. | |
| 2006/0001721 | A1 | 1/2006 | Yraceburu et al. | |
| 2011/0205282 | A1 | 8/2011 | Houjou | |

FOREIGN PATENT DOCUMENTS

| | | |
|---|---|---|
| JP | 60-136776 U | 9/1985 |

OTHER PUBLICATIONS

IP.com search.*

International Search Report, issued in PCT/EP2015/077195, dated Jan. 7, 2016.

Written Opinion of the International Searching Authority, issued in PCT/EP2015/077195, dated Jan. 7, 2016.

* cited by examiner

*Primary Examiner* — Lisa M Solomon

(74) *Attorney, Agent, or Firm* — Birch, Stewart, Kolasch & Birch, LLP

(57) ABSTRACT

A gas impingement device includes a first surface including a pattern of a plurality of gas outlets, the pattern including a number of substantially parallel rows of gas outlets, the rows arranged in a direction, which direction is at a skew angle α with a front edge of the first surface of the gas impingement device. A recording substrate treatment apparatus and a printing system including such a gas impingement device and a method of drying a recording substrate by using the gas impingement device are also disclosed.

16 Claims, 4 Drawing Sheets

GAS IMPINGEMENT DEVICE, RECORDING SUBSTRATE TREATMENT APPARATUS AND PRINTING SYSTEM COMPRISING SUCH GAS IMPINGEMENT DEVICE

CROSS-REFERENCE TO RELATED APPLICATIONS

This application is a Continuation of PCT International application No. PCT/EP2015/077195, filed on Nov. 20, 2015. PCT/EP2015/077195 claims priority under 35 U.S.C. § 119 to Application No. 14195318.2, filed in Europe on Nov. 28, 2014. The entirety of each of the above-identified applications is expressly incorporated herein by reference.

BACKGROUND OF THE INVENTION

1. Field of the Invention

The present invention relates to a gas impingement device. The gas impingement device according to the present invention can be suitably used in a drying and/or fixation device, in particular in a drying and/or fixation device used in an (inkjet) printing device.

2. Background of the Invention

In general, air impingement can be used in drying techniques for enhancing evaporation of water. Air impingement is well known in the paper drying technology. In a typical dryer, preferably, first heat is submitted to the paper in order to increase the paper temperature. Thereafter, the use of air impingement, i.e. using air with a high velocity perpendicular to the surface of the paper, is a well known technique for boosting evaporation of moisture out of the paper surface. The technology is most commonly used in paper drying technologies for web based applications. Also, the technology can be used in printing technologies for drying wet ink jet sheets.

However, often, all types of blowing boxes with all kinds of gas outlet holes or slits are termed air impingement. Although design rules for optimum air impingement arrangements are known and can be found in literature, one often sees inferior impingement techniques (like using slits instead of a hole pattern, or with non-optimum hole geometries or with non-optimum substrate distance, or with far too low air velocity). For proper air impingement, the impingement flow should be perpendicular to the substrate, with a high gas velocity (air velocity) and an impingement device should preferably have a well thought out and designed equally distributed dense hole pattern, thereby creating turbulences at the surface of the substrate. In that way, the gas (air) boundary layer at the surface of the (recording) substrate can be refreshed.

Gas impingement devices known from the prior art may comprise a hollow box, fed with a gas flow (air) by a fan. The box may typically have a hole pattern (gas outlets), directing a gas flow (air) towards a (recording) substrate. The length of the box may be suitably selected dependent on the width of the used (recording) substrate (e.g. web width or sheet width or length) perpendicular to a transport direction. Although the impingement width in the transport direction is not limited, an optimum width for optimum performance can also be calculated in accordance with known design rules.

For paper drying techniques in a paper mill, where the paper is very wet, impingement lengths of a meter or several meters are common. For sheet drying techniques in printers, where a relatively small amount of moisture present on the printed surface of a recording substrate has to be removed, the impingement width may be on the order of several cm.

For effective gas (air) impingement, the gas impingement device and the gas impingement process need to be carefully designed, such that hole patterns (gas outlets) layout, hole diameter and distance to substrate are well matched. Furthermore, the gas (air) velocity, for reaching optimum and high mass transfer, must be rather high, typically in a range of 50-80 m/s.

For web based drying techniques, multiple commercial gas impingement solutions are available (e.g. Metso, Voith). For cut sheet drying techniques in printers, there are only a few known examples (e.g. Xerox).

In high speed printing, an image printed on a recording substrate must be dried and fixed (very) fast. At such high printing speeds, the drying capacity of a drying and fixing device becomes limited due to formation of a saturated boundary layer of a (volatile) solvent, e.g. water, at and near the surface of the recording substrate, limiting further evaporation of said solvent. Therefore, in order to increase the drying capacity of the drying and fixing device, gas (air) impingement can be applied for breaking said boundary layer. Proper impingement therefore requires high gas (air) velocity impingement.

It is a disadvantage of the known impingement devices that such devices are not suitable for use in high speed cut-sheet printing systems. For example, if such impingement devices are used for high velocity gas impingement in a cut-sheet printing system, sheets of recording substrate are easily blown away, and/or floating and/or curling of the transported sheet of recording substrate may occur, in particular in printing systems wherein sheets of a recording substrate are temporarily fixated onto a transportation device by, e.g. vacuum fixation, electrostatic fixation or wherein sheets of a recording substrate are transported through nips. These are undesired effects because the reliability of the printing process and/or sheet transport may be adversely affected.

SUMMARY OF THE INVENTION

It is therefore an object of the present invention to provide a gas impingement device that can be suitably used in a high speed cut-sheet printing system. Such a gas impingement device can be operated at a high gas impingement velocity without causing a sheet of recording substrate to be blown away and/or without floating and/or curling of the transported sheets of recording substrate to occur, such that sheets remain on the transport surface of a transporting device, while gas impingement is performed.

The object is achieved by providing a gas impingement device comprising a hollow body, a gas inlet fluidly connected to the hollow body and a first surface comprising a first axis and a second axis, the second axis being substantially perpendicular to the first axis, wherein in operation a sheet of a printing substrate is transported in a first direction such that an edge of the printing substrate is substantially parallel to the first axis of the first surface, wherein the surface is provided with a plurality of gas outlets each having a diameter $d_{outlet}$, the gas outlets being fluidly connected to the body, the plurality of gas outlets being arranged in a pattern, the pattern comprising a number of substantially parallel rows extending in a second direction, each row comprising a fraction of the plurality of gas outlets such that the plurality of gas outlets is substantially equally distributed across the first surface and such that the fraction of the plurality of gas outlets on each row is arranged at an equidistant stitch, $d_{stitch}$ and wherein the second direction is arranged at an angle $\alpha$ with the first axis of the first surface, wherein $\alpha \geq \arctan(d_{outlet}/d_{stitch})$.

In this arrangement, which comprises a skewed pattern of gas outlets relative to the first axis (which axis is substantially perpendicular to the transport direction of the recording substrate), no direct adjacent gas outlets in the same row of gas outlets impinge a front and/or trailing edge of a sheet of recording substrate simultaneously. The total number of gas outlets that impinge a front and/or trailing edge of a sheet of recording substrate is therefore smaller than the total number of gas outlets in a row. Therefore, the total impinging gas flow on a front and/or trailing edge is relatively small, such that blowing away the sheet and/or floating and/or curling of the sheet as described above is prevented or at least mitigated.

In an embodiment, the pattern of the plurality of gas outlets comprises a first row comprising a first fraction of the plurality of gas outlets and a second row comprising a second fraction of the plurality of gas outlets, the first row extending in the second direction and the second row being substantially parallel to the first row, wherein the first row and the second row are arranged at a distance $d_{row}$, and wherein the second fraction of gas outlets comprised in the second row is shifted in the second direction by $x*d_{stitch}$, relative to the first fraction of gas outlets comprised in the first row, wherein $0 \leq x < 1$ and wherein $\alpha \leq \arctan(d_{row}/((1+x)*d_{stitch}))$.

In this embodiment, an upper limit of the skew angle $\alpha$ is defined. At a skew angle below this limit, the distance between two gas outlets acting on a front and/or trailing edge of a recording substrate is larger than $d_{stitch}$.

In an embodiment, x=0.5.

In an embodiment, $d_{row}=y*d_{stitch}$, wherein $0<y\leq 1$ and wherein $d_{row}>d_{outlet}$.

In an embodiment, $y=0.5*\sqrt{3}$.

In an embodiment, y=0.5.

In an embodiment, x=0.5 and $y=0.5*\sqrt{3}$.

In this embodiment, the pattern of gas outlets comprises an equilateral triangular pattern. In accordance with the present invention, the skew angle $\alpha$ for such a pattern is between $\arctan(d_{outlet}/d_{stitch})$ and 30°, with the proviso that $\arctan(d_{outlet}/d_{stitch})<30°$.

In an embodiment, x=0.5 and y=0.5.

In this embodiment, the pattern of gas outlets comprises a nested square pattern. In accordance with the present invention, the skew angle $\alpha$ for such a pattern is between $\arctan(d_{outlet}/d_{stitch})$ and 18.4°, with the proviso that $\arctan(d_{outlet}/d_{stitch})<18.4°$.

In an embodiment, x=0 and y=1.

In this embodiment, the pattern of gas outlets comprises a squared pattern. In accordance with the present invention, the skew angle $\alpha$ for such a pattern is between $\arctan(d_{outlet}/d_{stitch})$ and 45°, with the proviso that $\arctan(d_{outlet}/d_{stitch})<45°$.

In an embodiment, $d_{outlet}$ is in a range of between 0.5 mm and 6 mm, preferably between 1 mm and 5 mm, more preferably between 1.5 mm and 4 mm.

In an embodiment, $d_{stitch}$ is in a range of between 2 mm and 50 mm, preferably between 4 mm and 40 mm, more preferably between 6 mm and 32 mm.

In an embodiment, $d_{stitch}=q*d_{outlet}$, wherein $4\leq q\leq 8$, preferably $5\leq q\leq 7$, more preferably q is substantially equal to 6.

In an embodiment, the surface provided with the plurality of gas outlets comprises a plate comprising a plurality of orifices.

In an embodiment, the plate comprising the plurality of orifices may be an integral part of the body of the gas impingement unit.

In an embodiment, the first surface of the impingement device comprises a width extending in the first direction, wherein the surface comprises a front edge arranged at an entry side of the impingement device and in operation substantially in parallel with the front and/or trailing edge of the recording substrate, the first surface further comprises a first zone having a width $d_{zone1}$, located adjacent to the front edge and a second zone having a width $d_{zone2}$, located adjacent to the first zone, the impingement device comprising a first plurality of gas outlets having a diameter $d_{outlet1}$ and a second plurality of gas outlets having a diameter $d_{outlet2}$, wherein the first plurality of gas outlets is arranged in the first zone and the second plurality of gas outlets is arranged in the second zone, and wherein $d_{outlet1}<d_{outlet2}$.

The entry side of the impingement device is defined as the side where in operation the recording substrates enter a gas impingement region provided by the impingement device.

In this embodiment, smaller diameter gas outlets are used at the entry side of the gas impingement device to further reduce the impact of gas impingement on front and trailing edges of cut-sheet recording substrates, when entering the gas impingement region.

In a further embodiment, the first surface further comprises a trailing edge arranged at an exit side of the impingement device and in operation substantially in parallel with the front and/or trailing edge of the recording substrate, and a third zone having a width $d_{zone3}$, located adjacent to the trailing edge, the impingement device comprising a third plurality of gas outlets having a diameter $d_{outlet3}$, wherein the third plurality of gas outlets is arranged in the third zone $d_{outlet3}<d_{outlet2}$.

The exit side of the impingement device is defined as the side where in operation the recording substrates exit a gas impingement region provided by the impingement device.

$d_{outlet3}$ may be the same or different from $d_{outlet1}$ as long as both $d_{outlet3}$ and $d_{outlet1}$ are smaller than $d_{outlet2}$.

In this embodiment, smaller diameter gas outlets are used at the exit side of the gas impingement device to further reduce the impact of gas impingement on front and trailing edges of cut-sheet recording substrates, when leaving the gas impingement region.

In another aspect, the present invention relates to a recording substrate treatment apparatus comprising a gas impingement device as described above. The recording substrate treatment apparatus further comprises a transporting device for transporting the recording substrate underneath the gas impingement device through a gas impingement region.

In an embodiment, the transporting device comprises a transporting surface arranged for holding the recording substrate, wherein the first surface of the impingement device is arranged opposite the transporting surface of the transporting device at a distance of substantially $z*d_{outlet}$, wherein $6\leq z\leq 10$, preferably $7\leq z\leq 9$, more preferably z=8.

In an embodiment, the recording substrate treatment apparatus further comprises a heating device.

The heating device may be a heating device for directly heating the recording substrate, in particular a radiation heating device, such as medium-wave and carbon (CIR) infrared heaters which operate at filament temperatures of around 1200° C. They reach maximum power densities of up to 60 $kW/m^2$ (medium-wave) and 150 $kW/m^2$ (CIR).

Direct heating of a sheet of recording substrate in the context of the present invention should be construed as transferring thermal energy (heat) to the sheet of the recording substrate mainly by conduction (e.g. with a heated platen) and/or radiation (e.g. with a radiation heater). Convective heat transport (e.g. via a gaseous medium) may have a contribution to the heating of the recording substrate. However, such contribution is small relative to heating by conduction and/or radiation. Therefore, heating of the recording substrate mainly by circulating a hot (gaseous) medium, e.g. hot air is not considered to be a form of direct heating in the context of the present invention.

In another aspect, the present invention relates to a printing device comprising the gas impingement device as described above.

In an embodiment, the printing device comprises the recording substrate treatment apparatus described above.

In an embodiment, the printing device further comprises an imaging device, preferably an ink jet imaging device.

In yet another aspect, the present invention relates to a method of drying a recording substrate comprising a wet surface, by using a recording substrate treatment apparatus comprising the gas impingement device according to the present invention, and a transporting device for transporting a sheet of the recording substrate underneath the gas impingement device, through a gas impingement region; the method comprising the steps of:

transporting a sheet of the recording substrate comprising a wet surface with the transporting device underneath the gas impingement device, through the gas impingement region; and impinging gas at a wet surface of the recording substrate at a gas velocity of between 40 m/s and 90 m/s, preferably between 50 m/s and 85 m/s, more preferably between 60 m/s and 80 m/s.

The wet surface may comprise a solvent originating from the printed ink.

In an embodiment, the recording substrate treatment apparatus further comprises a heating device, and the method further comprises the step of heating the recording substrate prior to the gas impingement step.

The method according to this embodiment provides a two stage drying method suitable for use in high speed cut-sheet printing processes. The sheets of printed (i.e. wet) recording substrates are first thoroughly heated such that solvent evaporation is initiated, in a second step the solvent saturated boundary layer is broken by high velocity gas impingement.

In any aspect of the present invention, the solvent is water in case of aqueous ink (jet) printing. However, the gas impingement device, recording substrate treatment apparatus and the method may also be used in combination with (other) solvent ink systems and processes.

In any aspect of the present invention, gas impingement may be air impingement. However, other impingement gases may also be used.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2A and FIG. 2B are schematic representations of a pattern of gas outlets comprised in a first surface of a gas impingement device, wherein FIG. 2A is according to the background art and FIG. 2B is according to an embodiment of the present invention;

FIG. 4A and FIG. 4B are schematic representations of the determination of the upper boundary of the skew angle $\alpha$ of a skewed pattern of gas outlets comprised in a first surface of a gas impingement device according to the present invention, wherein FIG. 2A is an equilateral triangular pattern and FIG. 2B is a nested square pattern.

DETAILED DESCRIPTION OF THE PREFERRED EMBODIMENTS

Figure 1:
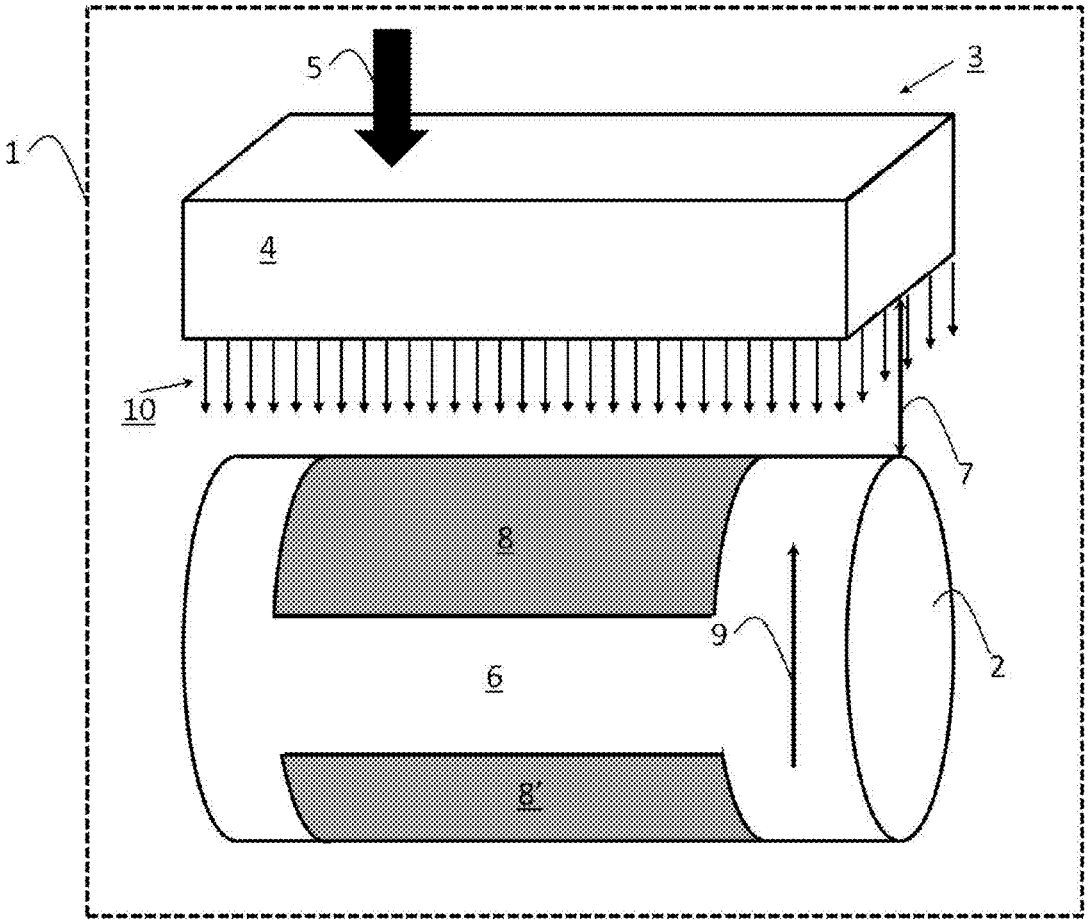
FIG. 1 is a schematic representation of a recording substrate treatment apparatus according to an embodiment of the present invention.

The present invention will now be described with reference to the accompanying drawings, wherein the same or similar elements are identified with the same reference numeral.

FIG. 1 is a schematic representation of a substrate treatment apparatus 1 comprising a transporting device 2, in this particular example being a drum, and a gas impingement device 3 comprising a hollow body 4, a gas inlet, indicated with arrow 5 and a plurality of gas outlets arranged in a pattern in a first surface of the hollow body 4 (not shown here). The first surface is arranged opposite a transporting surface 6 of the transporting device and at a distance 7 from the transporting surface 6, in this particular example substantially $8*d_{outlet}$. In operation, the transporting device 2 carries one or more printed sheets of recording substrate 8, and 8' on transporting surface 6, which sheets are transported in a direction as indicated with arrow 9. In operation, a gas flow, usually air, is fed to the hollow body 4 of the gas impingement device 3 as is indicated with arrow 5. Said gas flow enters the hollow body 4 and is distributed among the plurality of gas outlets into a plurality of high velocity impinging gas flows (indicated with multiple arrows 10) towards the sheet of recording substrate 8 that is transported underneath the gas impingement device 3 at that instant. The gas velocity is preferably between 50 m/s and 80 m/s.

The sheets of recording substrate can be held down onto the transporting surface 6 of the transporting device 2 in several ways, such as electrostatically, by vacuum force, by grippers, etc.

Figure 2A:
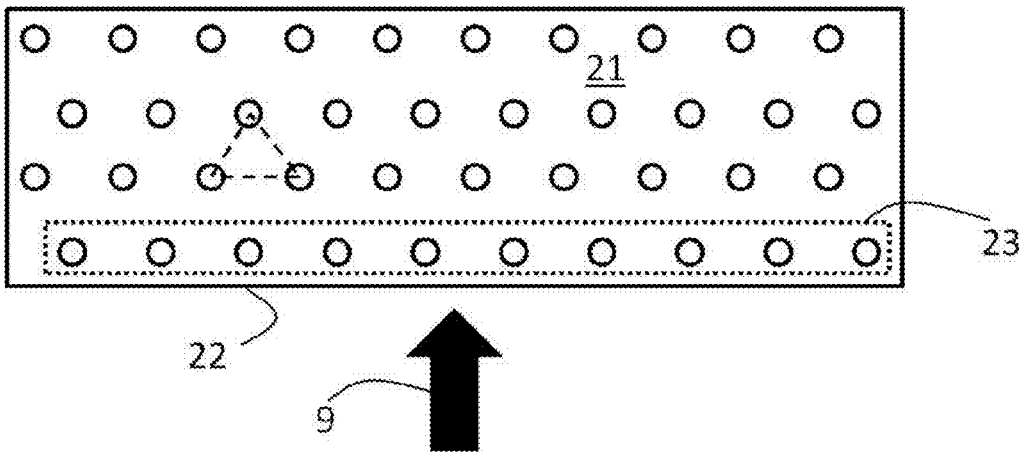
Figure 2B:
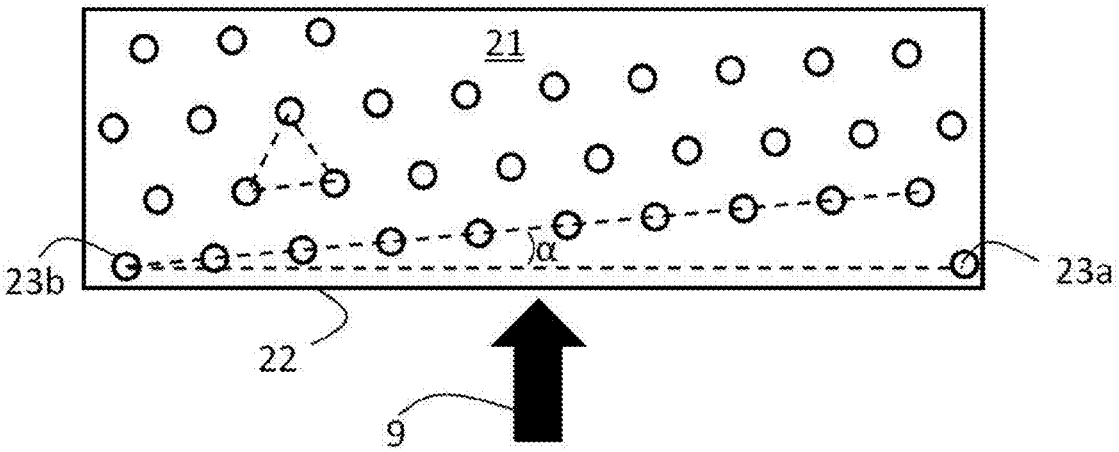

FIG. 2A and FIG. 2B are a schematic representation of a pattern of gas outlets comprised in a first surface 21 of a gas impingement device 3 shown in FIG. 1 and described above. FIG. 2A shows a pattern of gas outlets according to the background art. Arrow 9 indicates the transportation direction of a sheet of recording substrate (see also FIG. 1). A front edge of the sheet of recording substrate (not shown) will be substantially in parallel with the front edge 22 of the gas impingement device when the sheet enters the air impingement region. The first row of gas outlets 23, in this particular example comprising 10 gas outlets, impinge the front edge of the sheet of recording medium at once and simultaneously. The impinging air flow of the first row of gas outlets 23 may cause floating and/or curling of the sheet of recording medium and even blowing away said sheet. In an embodiment according to the present invention and shown in FIG. 2B, the pattern of gas outlets is skewed at an angle $\alpha$ with reference to the front edge 22 of the gas impingement device 3. In this arrangement, only 2 gas outlets (23*a* and 23*b*) impinge the front edge of the sheet of recording medium at once and simultaneously. Therefore, the total impinging gas flow acting on the front edge of a recording substrate is much lower compared to the pattern of gas outlets of the background art (FIG. 2A), in this particular example only 20%, assuming that in both cases (FIG. 2A and FIG. 2B) the gas flow per gas outlet is substantially the same. Therefore, the risk of causing floating and/or curling of, or even blowing away a sheet of recording substrate upon transportation underneath a gas impingement device is significantly reduced. Upon further transportation of the recording substrate, more of the plurality of impinging gas flows may act on the front edge of the recording substrate, however, by then a significant part of the surface of the recording substrate is impinged, such that the blowing force acting on said surface is large enough to hold the recording substrate down.

For an effective design of a gas impingement device, two adjacent gas outlets in the same row (e.g. 23 in FIG. 2A) may impinge a front (or trailing) edge of a sheet of recording substrate simultaneously.

Figure 3:
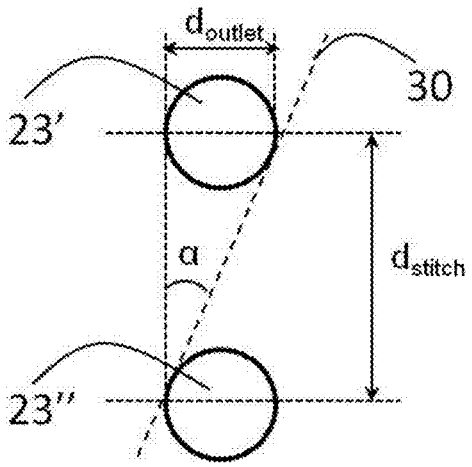
FIG. 3 is a schematic representation of the determination of the lower boundary of the skew angle $\alpha$ of a skewed pattern of gas outlets comprised in a first surface of a gas impingement device according to the present invention.

FIG. 3 shows a schematic representation of the determination of the lower boundary of the skew angle $\alpha$ of a skewed pattern of gas outlets comprised in a first surface of a gas impingement device according to the present invention. Gas outlets 23' and 23" are adjacent gas outlets in row 23 (FIG. 2A), said gas outlets are arranged at a distance $d_{stitch}$ from one another. Dotted line 30 indicates the position of a front (or trailing) edge of a sheet of recording substrate. In the shown position of said front (or trailing) edge, only one of gas outlets 23' and 23" impinges said edge. Therefore, the lower boundary of the skew edge $\alpha$ can be calculated with the following equation: $\alpha=\arctan(d_{outlet}/d_{stitch})$. For example, in a pattern of gas outlets having a diameter of 1 mm, and wherein the distance between two adjacent gas outlets in a row is 15 mm, the lower boundary of the skew angle $\alpha=3.8$.

It is further preferred that all gas outlets are evenly distributed across the first surface (21 FIG. 2A and FIG. 2B) of the hollow body (4 FIG. 1). Even distribution may be obtained by a regular pattern of gas outlets as is shown in FIG. 4A and FIG. 4B.

Figure 4A:
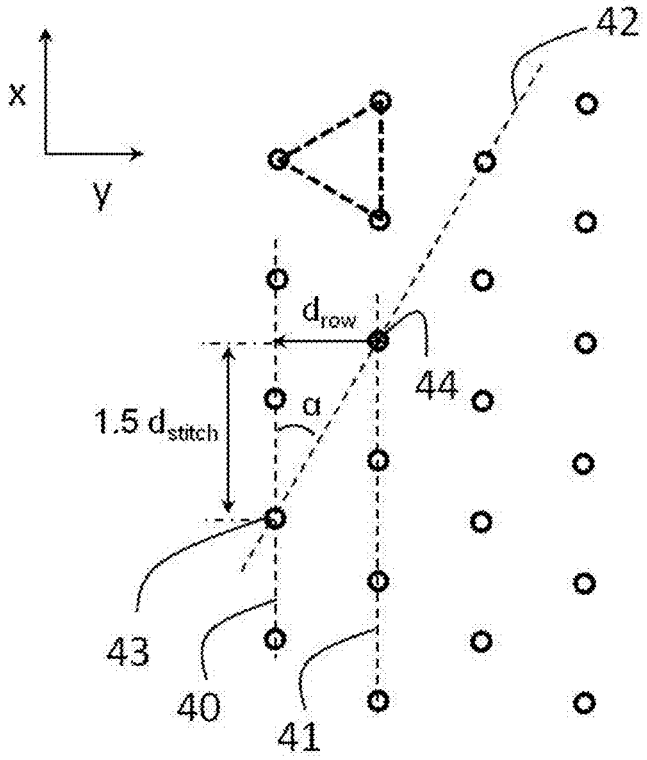

FIG. 4A shows a schematic representation of an equilateral triangular pattern of gas outlets. FIG. 4A shows a first row 40 of gas outlets and a second row 41 of gas outlets. The gas outlets of the second row 41 are shifted relative to the gas outlets in the first row 40 by half the distance between two adjacent gas outlets in a row (i.e. $0.5*d_{stitch}$). The upper limit of the skew angle can be determined by calculating the angle between a front (or trailing) edge of a sheet of a recording substrate as indicated by dotted line 42. This front (or trailing) edge is covered by gas outlet 43 of the first row and gas outlet 44 of the second row. Further increasing the skew angle has no effect on the distance between two gas outlets impinging on the front (or trailing) edge of a sheet of recording substrate. The projection of gas outlet 44 onto the first row 40 shows that the distance in the x-direction equals 1.5 $d_{stitch}$, and because each triangle of gas outlets constitutes an equilateral triangle, the distance between two adjacent rows $d_{row}$ (y-direction), here shown for the first row 40 and the second row 41, equals $0.5*\sqrt{3}*d_{stitch}$. Then, the upper limit of the skew angle $\alpha$ can be calculated as follows: $\alpha=\arctan(d_{row}/(1.5*d_{stitch}))=\arctan(1/3*\sqrt{3})=30$.

Figure 4B:
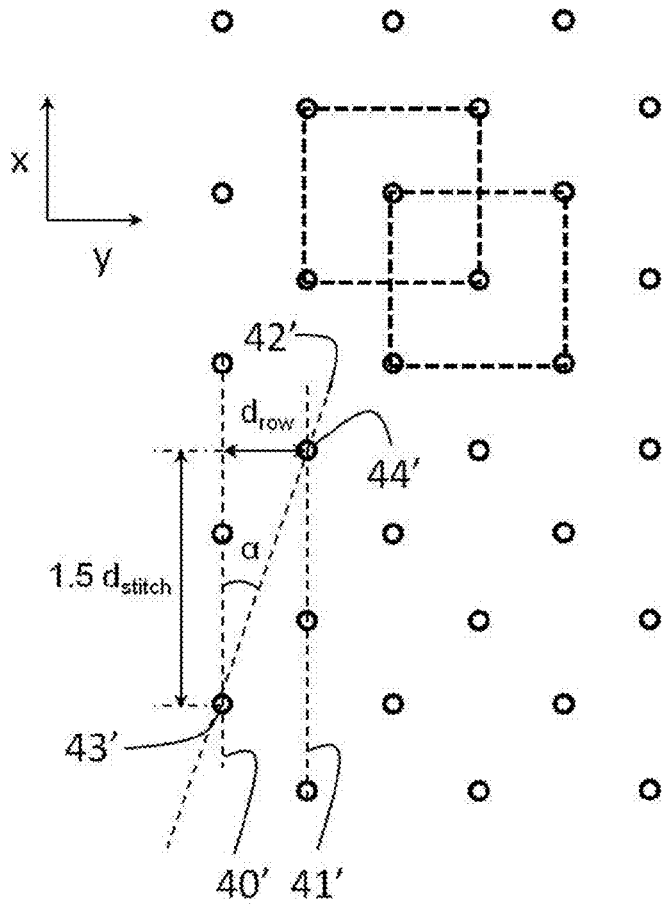

FIG. 4B is a schematic representation of a nested square pattern of gas outlets. For this arrangement, a similar calculation as described above can be made. The projection of gas outlet 44' onto the first row 40' shows that the distance in the x-direction again equals 1.5 $d_{stitch}$, and because each gas outlet on the second row is located in the center of a square formed by the adjacent gas outlets in the first and the third row, the distance between two adjacent rows $d_{row}$, here shown for the first row 40' and the second row 41' equals $0.5*d_{stitch}$. Then, the upper limit of the skew angle $\alpha$ can be calculated as follows: $\alpha=\arctan(d_{row}/(1.5*d_{stitch}))=\arctan(1/3)=18.4$.

Alternatively for a squared pattern (not shown), the upper limit of the skew angle is defined by the angle of the diagonal of a square formed by 4 gas outlets with a base rib of said square, which angle is by definition 45.

Figure 5:
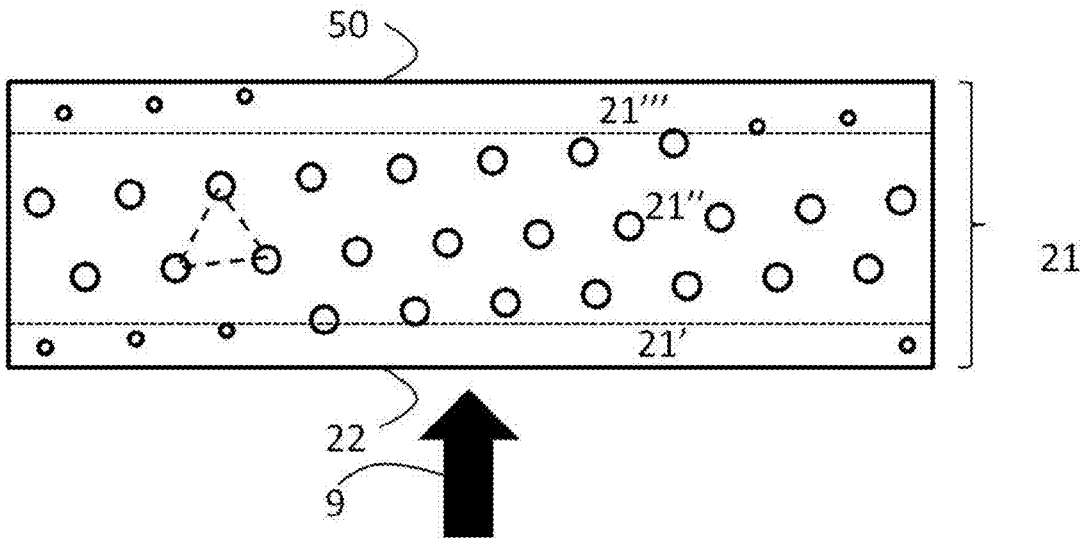
FIG. 5 is a schematic representation of a pattern of gas outlets comprised in a first surface of a gas impingement device according to an embodiment of the present invention.

FIG. 5 is a schematic representation of a pattern of gas outlets comprised in a first surface 21 of a gas impingement device. The first surface 21 comprises a first zone 21' a second zone 21" and a third zone 21'". The first zone 21' is arranged adjacent to the front edge 22 of the first surface 21 and comprises a first plurality of gas outlets having a first diameter, $d_{outlet1}$. The second zone 21" is arranged in between the first zone 21' and the third zone 21'" and comprises a second plurality of gas outlets having a second diameter, $d_{outlet2}$. The third zone 21'" is arranged adjacent to the trailing edge 50 of the first surface 21 and comprises a third plurality of gas outlets having a third diameter, $d_{outlet3}$. The diameters of the gas outlets in both the first and the third zones are smaller than the diameters of the gas outlets in the second zone. $d_{outlet1}$ and $d_{outlet3}$ may be the same or different. The transportation direction of a sheet of recording medium is again indicated with arrow 9.

With this arrangement, the impact of gas impingement on front and trailing edges of cut-sheet recording substrates, when entering the gas impingement region can be further reduced.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims is herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term "in fluid connection" or "operatively connected", as used herein, are defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A gas impingement device comprising:

a hollow body;

a gas inlet fluidly connected to the hollow body; and a first surface comprising a first axis and a second axis, wherein the second axis is substantially perpendicular to the first axis, wherein the first surface is provided with a plurality of gas outlets, each of the plurality of gas outlets having a diameter $d_{outlet}$, the plurality of gas outlets being fluidly connected to the body and being arranged in a pattern, wherein the pattern comprises a number of substantially parallel rows extending in a second direction, each row comprising a fraction of the plurality of gas outlets such that the plurality of gas outlets is substantially equally distributed across the first surface and such that the fraction of the plurality of gas outlets on each row is arranged at an equidistant stitch, $d_{stitch}$, wherein the second direction is arranged at an angle $\alpha$ with the first axis of the first surface, wherein $\alpha \geq \arctan(d_{outlet}/d_{stitch})$, and wherein in operation a sheet of a printing substrate is transported in a first direction such that an edge of the printing substrate is substantially parallel to the first axis of the first surface.

2. The gas impingement device according to claim 1, wherein the pattern of the plurality of gas outlets comprises a first row comprising a first fraction of the plurality of gas outlets and a second row comprising a second fraction of the plurality of gas outlets, the first row extending in the second direction and the second row being substantially parallel to the first row, wherein the first row and the second row are arranged at a distance $d_{row}$, and wherein the second fraction of gas outlets comprised in the second row is shifted in the second direction by $x*d_{stitch}$, relative to the first fraction of gas outlets comprised in the first row, wherein $0 \leq x < 1$ and $\alpha \leq \arctan(d_{row}/((1+x)*d_{stitch}))$.

3. The gas impingement device according to claim 2, wherein $d_{row}=y*d_{stitch}$, wherein $0<y\leq 1$ and $d_{row}>d_{outlet}$.

4. The gas impingement device according to claim 2, wherein $x=0.5$ and $y=0.5*\sqrt{3}$.

5. The gas impingement device according to claim 4, wherein $x=0.5$ and $y=0.5$.

6. The gas impingement device according to claim 4, wherein $x=0$ and $y=1$.

7. The gas impingement device according to claim 5, wherein $d_{outlet}$ is in a range of between 0.5 mm and 6 mm.

8. The gas impingement device according to claim 5, wherein $d_{stitch}$ is in a range of between 2 mm and 50 mm.

9. The gas impingement device according to claim 1, wherein the surface provided with a plurality of gas outlets comprises a plate comprising a plurality of orifices.

10. A recording substrate treatment apparatus, comprising:

the gas impingement device according to claim 1; and a transporting device configured to transport the recording substrate underneath the gas impingement device through a gas impingement region.

11. A printing device comprising the gas impingement device according to claim 1.

12. A printing device comprising the recording substrate treatment device according to claim 10.

13. The printing device according to claim 11, further comprising an imaging device.

14. The printing device according to claim 12, further comprising an imaging device.

15. A method of drying a recording substrate comprising a wet surface, said method comprising the steps of:

using a recording substrate treatment apparatus comprising the gas impingement device according to claim 1 and a transporting device configured to transport a sheet of the recording substrate underneath the gas impingement device;

transporting a sheet of the recording substrate comprising the wet surface with the transporting device underneath the gas impingement device and through a gas impingement region of the gas impingement device; and impinging gas at the wet surface of the recording substrate at a gas velocity of between 40 m/s and 90 m/s.

16. The method according to claim 15, wherein the recording substrate treatment apparatus further comprises a heating device; and wherein method further comprises the step of heating the recording substrate prior to the gas impingement step.

* * * * *